US012768559B2

(12) United States Patent
Yook et al.

(10) Patent No.: US 12,768,559 B2
(45) Date of Patent: Oct. 20, 2026

(54) APPARATUS FOR DISCHARGING AIR

(71) Applicant: IUCF-HYU (INDUSTRY-UNIVERSITY COOPERATION FOUNDATION HANYANG UNIVERSITY), Seoul (KR)

(72) Inventors: Se Jin Yook, Seoul (KR); Su Hoon Park, Seoul (KR)

(73) Assignee: IUCF-HYU (INDUSTRY-UNIVERSITY COOPERATION FOUNDATION HANYANG UNIVERSITY), Seoul (KR)

( * ) Notice: Subject to any disclaimer, the term of this patent is extended or adjusted under 35 U.S.C. 154(b) by 153 days.

(21) Appl. No.: 18/726,316

(22) PCT Filed: Dec. 29, 2022

(86) PCT No.: PCT/KR2022/021575
§ 371 (c)(1),
(2) Date: Jul. 2, 2024

(87) PCT Pub. No.: WO2023/128640
PCT Pub. Date: Jul. 6, 2023

(65) Prior Publication Data

US 2025/0067460 A1 Feb. 27, 2025

(30) Foreign Application Priority Data

Jan. 3, 2022 (KR) ..... 10-2022-0000556
Jan. 3, 2022 (KR) ..... 10-2022-0000557
(Continued)

(51) Int. Cl.
*F24F 11/79* (2018.01)
*F24F 13/14* (2006.01)

(52) U.S. Cl.
CPC ..... *F24F 11/79* (2018.01); *F24F 2013/1473* (2013.01)

(58) Field of Classification Search
CPC .... F24F 1/79; F24F 13/06; F24F 13/12; F24F 13/14; F24F 2013/1473
See application file for complete search history.

(56) References Cited

U.S. PATENT DOCUMENTS 11,280,517 B1 * 3/2022 Jovicic ..... F24F 13/15
2014/0357179 A1 * 12/2014 Londiche ..... C22C 38/04 454/322
(Continued)

FOREIGN PATENT DOCUMENTS

FR 3088107 A1 5/2020
JP 6-137663 A 5/1994
(Continued)

OTHER PUBLICATIONS

International Search Report for PCT/KR2022/021575 dated Apr. 13, 2023.
Written Opinion for PCT/KR2022/021575 dated Apr. 13, 2023.

*Primary Examiner* — Marc E Norman
(74) *Attorney, Agent, or Firm* — Sughrue Mion, PLLC

(57) ABSTRACT

The present invention relates to an apparatus for discharging air. An apparatus for discharging air, according to one embodiment of the present invention, comprises: a duct having a path thereinside through which air flows in the forward and backward directions, and having an inlet formed at a rear end thereof, and an outlet formed at a front end thereof; and a wind direction control member located inside the duct, and having at least a partial area provided to be movable in the vertical direction so as to control the direction of air discharged through the outlet.

7 Claims, 25 Drawing Sheets

(30) Foreign Application Priority Data

Jan. 3, 2022 (KR) ..... 10-2022-0000558
Apr. 6, 2022 (KR) ..... 10-2022-0042999

(56) References Cited

U.S. PATENT DOCUMENTS

| | | | | |
|---|---|---|---|---|
| 2016/0361977 | A1 | 12/2016 | Freese et al. | |
| 2019/0126726 | A1* | 5/2019 | Uhlenbusch ..... | F24F 13/10 |

FOREIGN PATENT DOCUMENTS

| | | | |
|---|---|---|---|
| JP | 6-159784 | A | 6/1994 |
| JP | 8-25954 | A | 1/1996 |
| JP | 2000-177378 | A | 6/2000 |
| JP | 2002-122349 | A | 4/2002 |
| JP | 2017-13783 | A | 1/2017 |
| JP | 2019-202740 | A | 11/2019 |
| JP | 2020-111087 | A | 7/2020 |
| KR | 10-2003-0025411 | A | 3/2003 |

* cited by examiner

APPARATUS FOR DISCHARGING AIR

CROSS REFERENCE TO RELATED APPLICATIONS

This application is a National Stage of International Application No. PCT/KR2022/021575 filed Dec. 29, 2022, claiming priority based on Korean Patent Application No. 10-2022-0000556 filed Jan. 3, 2022, Korean Patent Application No. 10-2022-0000557 filed Jan. 3, 2022, Korean Patent Application No. 10-2022-0000558 filed Jan. 3, 2022, and Korean Patent Application No. 10-2022-0042999 filed Apr. 6, 2022.

Technical Field

The present invention relates to an apparatus for discharging air, and more particularly, to an apparatus for discharging air to use the Coanda effect so as to carefully control the air at various angles in the vertical direction and discharge the air.

Background Art

Apparatuses for discharging air, such as air conditioners, employ a structure for controlling the direction of air. In general, the above air direction control apparatuses are configured such that various components in a path through which the air is discharged and then the components interact with each other to guide the air and allow wind to proceed in the desired direction.

However, when several components are placed in the air discharge path to control the direction of the air, an assembly structure of the components may become complex and accordingly, the overall volume of the air direction control apparatus may be increased. In other words, the convenience when the air direction control apparatus is installed to a device such as an air conditioner may be reduced, and the aesthetics in terms of design may be deteriorated.

DISCLOSURE

Technical Problem

The present invention provides an apparatus for discharging air to use the Coanda effect so as to carefully adjust the air at various angles in the vertical direction and discharge the air.

In addition, the present invention provides an apparatus for discharging air to have a slim structure with a long bar shape in a lateral direction as a whole.

In addition, the present invention provides an apparatus for discharging air to have a structure for controlling a wind direction so as to be provided positioned inside a duct.

Technical Solution

An aspect of the present invention provides an apparatus for discharging air, which includes: a duct having a path thereinside through which air flows in forward and backward directions, and having an inlet formed at a rear end thereof and an outlet formed at a front end thereof; and a wind direction control member positioned inside the duct, and having at least a partial area provided to be movable in a vertical direction so as to control a direction of air discharged through the outlet.

In addition, the duct may include: passage portions having a preset length in the forward and backward directions and provided to face each other at a preset distance apart in the vertical direction, thereby forming a path through which the air flows; and skin portions positioned in a front end area in the forward and backward directions, having a preset length in the forward and backward directions, having areas facing each other at a preset distance apart in the vertical direction, thereby forming the outlet between the front ends, in which the areas facing each other are provided with skin surfaces protruding in a facing direction.

In addition, the skin surfaces may be gradually inclined in the facing direction as extending forward.

In addition, the skin surfaces may be inclined by a skin inclination angle in the forward and backward directions.

In addition, the wind direction control member may include an inlet-side control portion positioned in a rear area of the wind direction control member, and having a front end provided with a support shaft having a length extending in the lateral direction, so as to be rotatable in the vertical direction about the support shaft as an axis.

In addition, the wind direction control member may further include an outlet-side control portion positioned in a front area of the wind direction control member and fixed inside the duct.

In addition, the outlet-side control portion may have at least a partial area positioned between the skin portions.

In addition, the outlet-side control portion may be positioned in a central area in the vertical direction in an internal space of the duct.

In addition, the apparatus may further include a drive cam connected to a connection shaft coupled to the inlet-side control portion to provide a power for rotating the inlet-side control portion.

In addition, the drive cam may be provided as a sphere.

In addition, the wind direction control member may include: an inlet-side control portion positioned in a rear area of the wind direction control member based on a rotation shaft provided in a lateral direction; and an outlet-side control portion positioned in the front area of the wind direction control member based on the rotation shaft.

In addition, the wind direction control member may be formed in a central area in the vertical direction thereof with a flow hole passing through in the forward and backward directions.

In addition, the apparatus may further include a drive member connected to the rotation shaft to provide a power for rotating the rotation shaft.

In addition, the wind direction control member may be provided to be movable in the vertical direction.

In addition, the apparatus may further include a drive cam to which a connection shaft, which has an outer end coupled to a side surface of the wind direction control member in a lateral direction and extends outward in the lateral direction, is inserted and connected, thereby providing a power for vertically moving the wind direction control member.

Advantageous Effects

According to one embodiment of the present invention, an apparatus for discharging air is provided so that the air can be carefully controlled at various angles in the vertical direction using the Coanda effect and discharged.

In addition, according to one embodiment of the present invention, the apparatus for discharging air is provided, so that a slim structure can be embodied with a long bar shape in a lateral direction as a whole.

In addition, according to one embodiment of the present invention, the apparatus for discharging air is provided, so that a structure for controlling a wind direction can be positioned inside the duct.

BEST MODE

Figure 1:
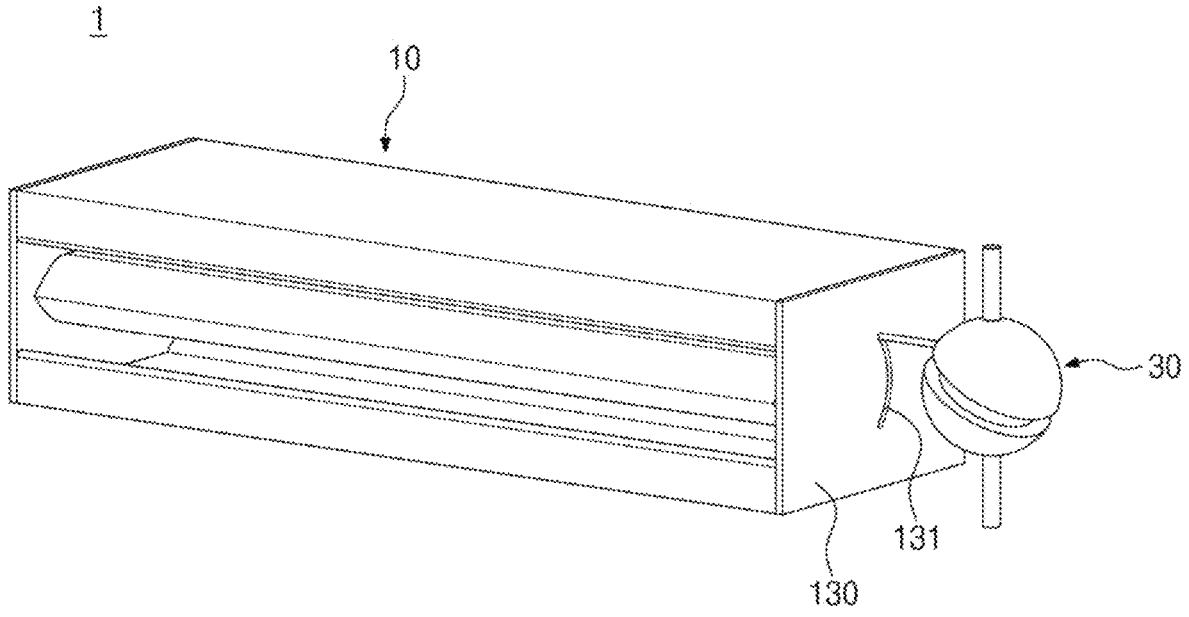
FIG. 1 is a view showing an apparatus for discharging air according to a first embodiment of the present invention.

An apparatus for discharging air according to one embodiment of the present invention includes: a duct having a path thereinside through which air flows in forward and backward directions, and having an inlet formed at a rear end thereof and an outlet formed at a front end thereof; and a wind direction control member positioned inside the duct, and having at least a partial area provided to be movable in a vertical direction so as to control a direction of air discharged through the outlet.

Mode for Invention

Hereinafter, exemplary embodiments of the present invention will be described in detail with reference to the accompanying drawings. However, the technical idea of the present invention is not limited to the exemplary embodiments described herein and may be embodied in other forms. Further, the embodiments are provided to enable contents disclosed herein to be thorough and complete and provided to enable those skilled in the art to fully understand the idea of the present invention.

In the specification, when one component is mentioned as being on another component, it signifies that the one component may be placed directly on another component or a third component may be interposed therebetween. In addition, in drawings, thicknesses of films and regions may be exaggerated to effectively describe the technology of the present invention.

In addition, although terms such as first, second and third are used herein to describe various components in various embodiments of the present specification, the components will not be limited by the terms. The above terms are used merely to distinguish one component from another. Accordingly, a first component referred to in one embodiment may be referred to as a second component in another embodiment. Each embodiment described and illustrated herein may also include a complementary embodiment. In addition, the term "and/or" is used herein to include at least one of the components listed before and after the term.

The singular expression herein includes a plural expression unless the context clearly specifies otherwise. In addition, it will be understood that the term such as "include" or "have" herein is intended to designate the presence of feature, number, step, component, or a combination thereof recited in the specification, and does not preclude the possibility of the presence or addition of one or more other features, numbers, steps, components, or combinations thereof. In addition, the term "connection" is used herein to include both indirectly connecting a plurality of components and directly connecting the components.

In addition, in the following description of the embodiments of the present invention, the detailed description of known functions and configurations incorporated herein will be omitted when it possibly makes the subject matter of the present invention unclear unnecessarily.

Hereinafter, regarding an apparatus 1 for discharging air according to the present invention, the direction into which air is introduced is called a backward direction, the direction from which the air is discharged is called a forward direction, and the direction perpendicular to the forward and backward directions on a horizontal plane is called a lateral direction.

Figure 2:
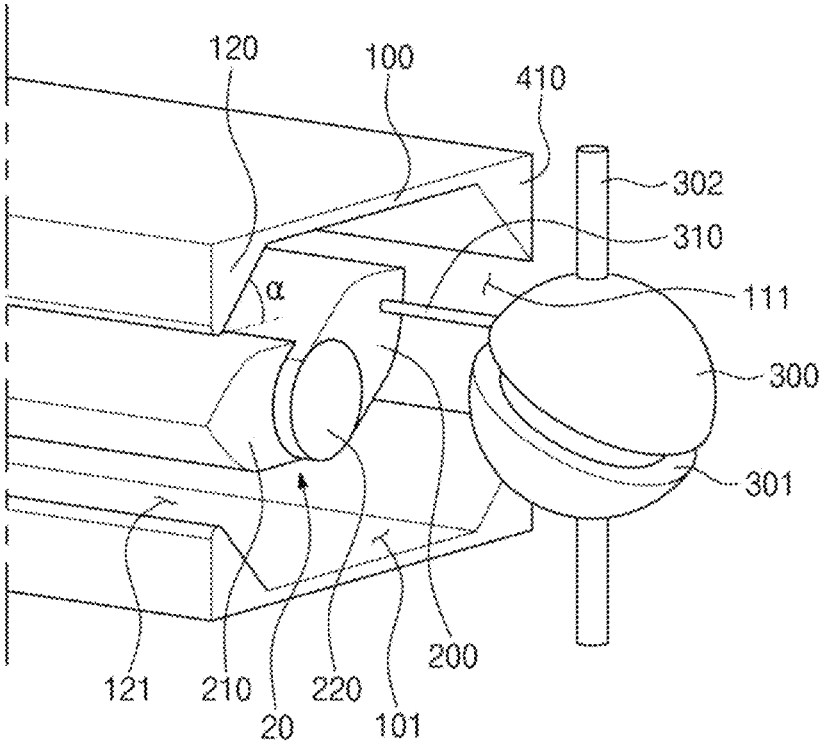
FIG. 2 is a view showing a left end of the apparatus for discharging air of FIG. 1 in which a side wall is omitted from a duct.

FIG. 1 is a diagram showing an apparatus for discharging air according to a first embodiment of the present invention, and FIG. 2 is a view showing a left end of the apparatus for discharging air of FIG. 1 in which a side wall is omitted from a duct.

Referring to FIGS. 1 and 2, the apparatus 1 for discharging air according to the first embodiment of the present invention includes a duct 10, a wind direction control member 20, and a drive member 30.

The duct 10 is provided to have a preset length in the forward and backward directions. The duct 10 has an inlet 111 formed at a rear end thereof and an outlet 121 formed at a front end thereof, so as to be formed therein with a path 101 through which air flows in the forward and backward directions. The duct is provided to have a preset width in the lateral direction. The duct 10 may be provided such that the width in the lateral direction is longer than the length in the forward and backward directions. The inlet 111 may be formed along and between both ends of the duct 10 in the lateral direction to have a slit shape. The outlet 121 may be formed along and between the both ends of the duct 10 in the lateral direction to have a slit shape. Side walls 130 may be positioned at the both ends of the duct 10 in the lateral direction.

The duct 10 includes passage portions 100, inlet portions 110, and skin portions 120.

The passage portions 100 are positioned in a center area in the forward and backward directions. The passage portions 100 have a preset length in the forward and backward directions and face each other at a preset distance apart in the vertical direction to form a path 101 through which the air flows.

The inlet portions 110 are positioned at rear end areas in the forward and backward directions. The inlet portions 110 have a preset length in the forward and backward directions and face each other at a preset distance apart in the vertical direction, thereby forming the inlet 111 through which the air flows between rear ends of the inlet portions 110. The areas facing each other in the inlet portions 110 protrude in the facing direction, in which a distance at which facing surfaces of the inlet portions 110 are spaced apart from each other may be smaller than a distance at which facing surfaces of the passage portions 100 are spaced apart from each other. The inlet portions 110 may be gradually inclined in direction facing each other as extending backward.

The skin portions 120 are positioned in front areas in the forward and backward directions. The skin portions 120 have a preset length in the forward and backward directions and face each other at a preset distance apart in the vertical direction, thereby forming the outlet 111 through which the air is discharged between front ends of the skin portions 120. The areas facing each other in the skin portions 120 are provided as skin surfaces, and the skin surfaces protrude in directions facing each other, in which a distance at which the skin surfaces are spaced apart from each other may be smaller than the distance at which the facing surfaces of the passage portions 100 are spaced apart from each other. The skin surfaces may be inclined in the direction facing each other as extending forward, so that the skin surface may be inclined by a skin inclination angle $\alpha$ in the forward and backward directions. The skin inclination angle $\alpha$ may be provided to have an acute angle. The upper skin portion 120 and the lower skin portion 120 may have the same or different skin inclination angles $\alpha$. In addition, the skin portions 120 positioned at the upper and lower portions of the duct 10 may have the same or different lengths in the forward and backward directions.

The wind direction control member 20 is positioned inside the duct 10 and has at least a partial area moving in the vertical direction to control the direction of the air discharged through the outlet 121. The wind direction control member 20 may be provided to have at least a partial area positioned between the skin portions 120 in the forward and backward directions. The width in the lateral direction of the wind direction control member 20 may be formed to correspond to the width in the lateral direction of the internal space of the duct 10. The wind direction control member 20 includes an inlet-side control portion 200, an outlet-side control portion 210, and a support shaft 220.

The inlet-side control portion 200 is positioned in the rear area of the wind direction control member 20. The inlet-side control portion 200 may be provided to be positioned between the passage portions 100. The inlet-side control portion 200 may be positioned in the center area in the vertical direction in the internal space of the duct 10. The inlet-side control portion 200 may have a rear end provided such that a thickness in the vertical direction becomes smaller as extending backward. The inlet-side control portion 200 may have the rear end so as to be rounded. The inlet-side control portion 200 may have the rear end so as to be formed sharply. The inlet-side control portion 200 may have a shape in which upper and lower areas are symmetrical to each other based on a reference line in the forward and backward directions. In addition, the inlet-side control portion 200 may have a shape in which upper and lower areas are asymmetrical to each other based on a reference line in the forward and backward directions.

A support shaft 220 extending in a lengthwise direction may be provided at the front end of the inlet-side control portion 200 in the lateral direction, so that the inlet-side control portion 200 may be rotatably provided in the vertical direction about the support shaft 220 as an axis. The support shaft 220 is provided to have at least a partial area fixed to the duct 10. As an example, the support shaft 220 may have lengthwise ends fixed to the side walls 130.

The outlet-side control portion 210 is positioned in the front area of the wind direction control member 20. The outlet-side control portion 210 may have at least a partial area positioned between the skin portions 120. The outlet-side control portion 210 may be positioned in the center area in the vertical direction in the internal space of the duct 10. The outlet-side control portion 210 may have upper and lower portions positioned to be spaced apart from the inner surfaces of the duct 10 by preset distances, respectively. The outlet-side control portion 210 may have a front end provided such that a thickness in the vertical direction becomes smaller as extending forward. The outlet-side control portion 210 may have the front end so as to be rounded. The outlet-side control portion 210 may have a front end tip so as to be formed sharply. The outlet-side control portion 210 may have a shape in which upper and lower areas are symmetrical to each other based on a reference line in the forward and backward directions. In addition, the outlet-side control portion 210 may have a shape in which upper and lower areas are asymmetrical to each other based on a reference line in the forward and backward directions. The outlet-side control portion 210 is provided to be fixed inside of the duct 10. As an example, the outlet-side control portion 210 may be coupled to the front end of the support shaft 220 or fixed to the side wall 130.

The drive member 30 is connected to the wind direction control member 20 to provide a power for vertically moving at least a partial area of the wind direction control member 20. The drive member 30 may be positioned outside the duct 10 in the lateral direction. The drive member 30 may be provided as a drive cam 300 (Cam). The drive cam 300 is connected to a cam drive shaft 302 having a lengthwise direction provided in the vertical direction so as to be rotatable about an axis in the vertical direction. The drive cam 300 may be provided as a sphere, and formed on an outer surface thereof with a cam groove 301. A connection shaft 310 coupled to the inlet-side control portion 200 may extend outward in the lateral direction, so that an outer end of the connection shaft 310 may be positioned to be inserted into the cam groove 301. When the drive cam 300 rotates, the connection shaft 310 moves along an arc-shaped trajectory, and thus the inlet-side control portion 200 rotates in the vertical direction. The side wall 130 may be disposed therein with the connection shaft 310, and formed therein with a communication hole 131 having a shape corresponding to the trajectory on which the connection shaft 310 moves. The cam groove 301 has a sufficient depth in the lateral direction to prevent the connection shaft 310 from being damaged when positions of the connection shaft 310 change in the vertical, forward and backward directions according to the rotation of the drive cam 300.

Figure 3:
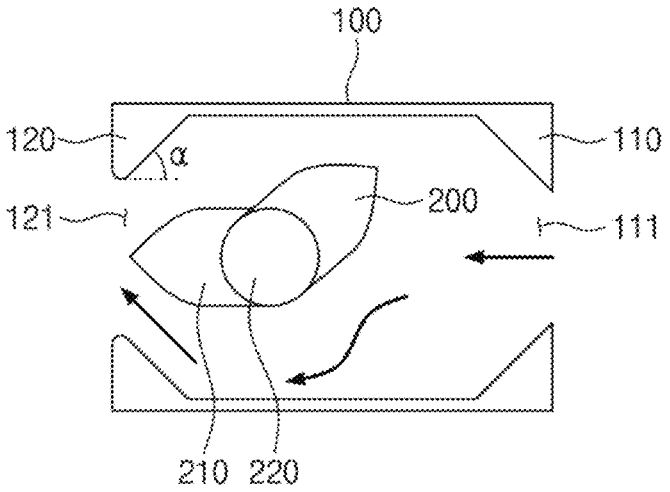
FIGS. 3 to 5 are views showing drive states of a wind direction control member when an upward wind is generated, a forward wind is generated, and a downward wind is generated in the apparatus for discharging air according to the first embodiment.
Figure 4:
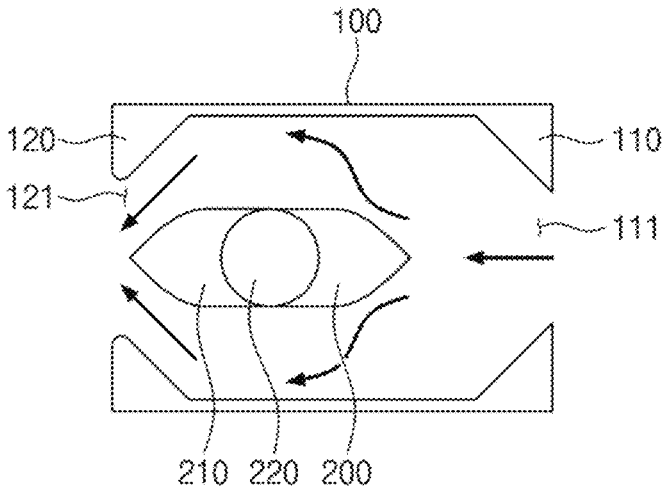
Figure 5:
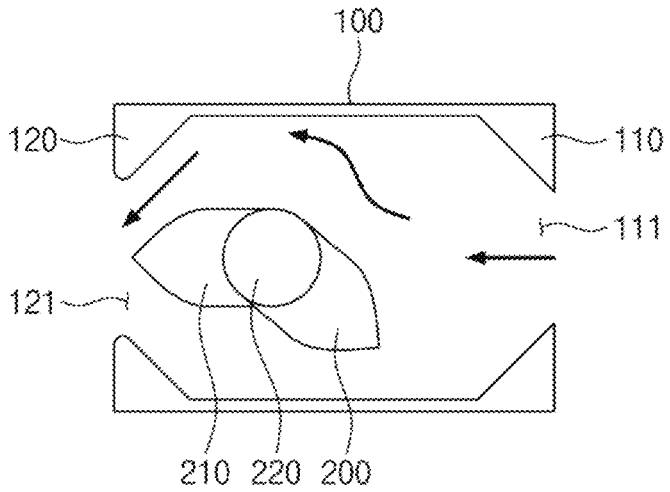

FIGS. 3 to 5 are views showing drive states of a wind direction control member when an upward wind is generated, a forward wind is generated, and a downward wind is generated in the apparatus for discharging air according to the first embodiment.

Referring to FIGS. 3 to 5, the wind direction discharged from the outlet is controlled using the Coanda effect depending on the drive state of the wind direction control member 20.

Specifically, as shown in FIG. 3, when the inlet-side control portion 200 maximally rotates upward, the air flowing into the inside of the duct 10 through the inlet 111 is minimized or blocked from flowing into a space above the wind direction control member 20 and flows into a space below the wind direction control member 20 while the Coanda effect occurs. Thereafter, the flow direction of the air is guided by the outlet-side control portion 210 and the skin surfaces and the Coanda effect occurs, so that the air is discharged from the outlet 121 upward.

In addition, as shown in FIG. 4, when the inlet-side control portion 200 is positioned to be directed to the forward and afterward directions, the air flowing into the inside of the duct 10 through the inlet 111 flows into the spaces above and below the wind direction control member 20 while the Coanda effect occurs. Thereafter, the flow direction of the air is guided by the outlet-side control portion 210 and the skin surfaces and the Coanda effect occurs, so that the air flowing through the space above the wind direction control member 20 and the air flowing therebelow are discharged forward from the outlet 121.

In addition, as shown in FIG. 5, when the inlet-side control portion 200 maximally rotates downward, the air flowing into the inside of the duct 10 through the inlet 111 is minimized or blocked from flowing into the space below the wind direction control member 20 and flows into the space above the wind direction control member 20 while the Coanda effect occurs. Thereafter, the flow direction of the air is guided by the outlet-side control portion 210 and the skin surfaces and the Coanda effect occurs, so that the air is discharged from the outlet 121 downward.

In addition, when the rotation degree of the inlet-side control portion 200 upward or downward is controlled, the air flowing in the spaces above and below the wind direction control member 20 is discharged through the outlet 121 in a controlled state, so that the wind direction may be formed at any angle between the upward wind and the forward wind according to FIG. 4, and at any angle between the downward wind and the forward wind according to FIG. 5. In addition, when the skin inclination angle $\alpha$, the inclination degree of the upper and lower parts with respect to the front-back reference line of the outlet-side control portion 210, and the thickness thereof are designed to be controlled, the inclination of the discharged air may be more precisely controlled in a desired form.

Figure 6:
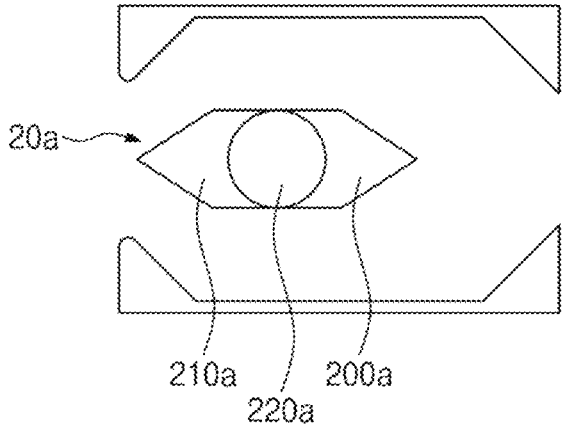
FIGS. 6 and 7 are views showing modifications of a wind direction control member in the apparatus for discharging air according to the first embodiment.
Figure 7:
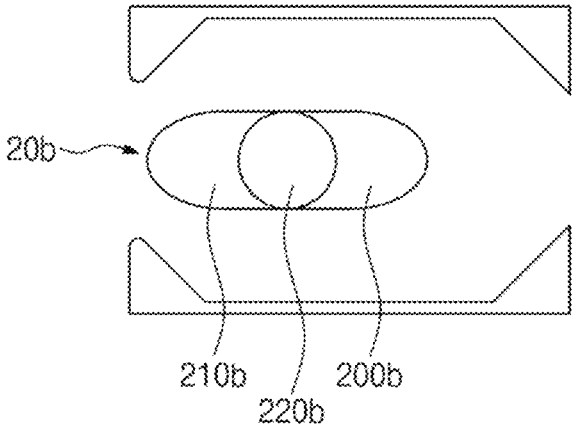

FIGS. 6 to 7 are views showing modifications of the wind direction control member in the apparatus for discharging air according the first embodiment.

Referring to FIG. 6, the wind direction control member 20*a* includes an inlet-side control portion 200*a*, an outlet-side control portion 210*a*, and a support shaft 220*a*.

The inlet-side control portion 200*a* is positioned in the rear area of the wind direction control member 20*a*. The inlet-side control portion 200*a* may have a rear end having a thickness in the vertical direction smaller as extending backward. The rear end of the inlet-side control portion 200*a* may be provided in a triangular shape. The inlet-side control portion 200 may have a rear end tip so as to be formed sharply. The inlet-side control portion 200*a* is provided to be rotatable in the vertical direction about the support shaft 220*a* as an axis.

The outlet-side control portion 210*a* is positioned in the front area of the wind direction control member 20*a*. The outlet-side control portion 210*a* may have a front end having a thickness in the vertical direction smaller as extending forward. The front end of the outlet-side control portion 210 may be provided in a triangular shape. The outlet-side control portion 210 may have a front end tip so as to be formed sharply.

In addition, referring to FIG. 7, the inlet-side control portion 200*b* may have a rear end having a thickness in the vertical direction smaller as extending backward. The inlet-side control portion 200*b* may have the rear end so as to be rounded. A rear end tip of the inlet-side control portion 200*b* may be formed to be rounded.

The outlet-side control portion 210*b* may have a front end having a thickness in the vertical direction smaller as extending forward. The outlet-side control portion 210*b* may have the front end so as to be rounded. A front end tip of the outlet-side control portion 210*b* may be formed to be rounded.

Figure 8:
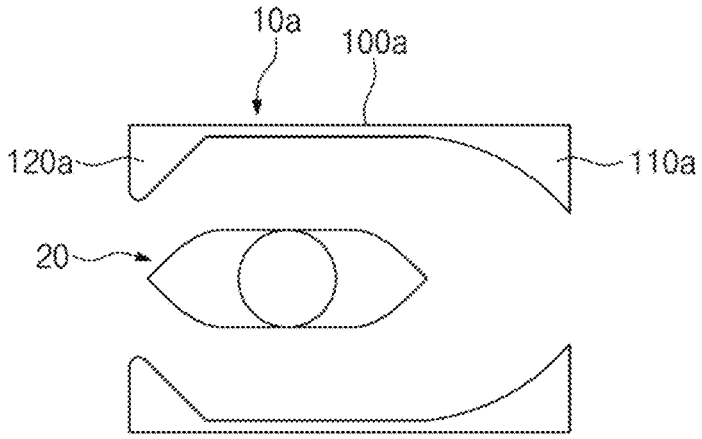
FIGS. 8 to 10 are views showing modifications of the duct in the apparatus for discharging air according to the first embodiment.
Figure 9:
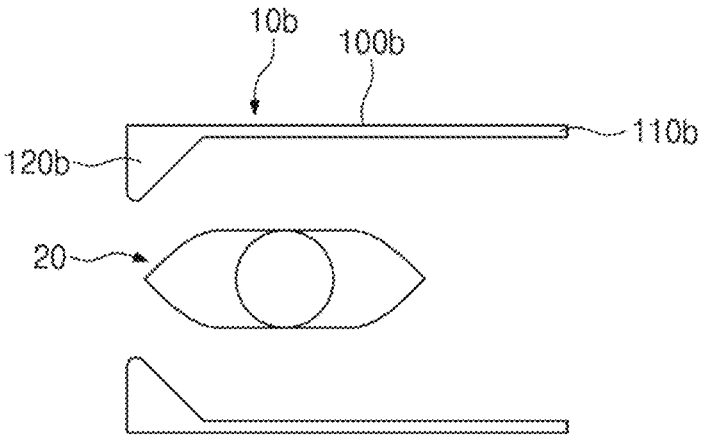
Figure 10:
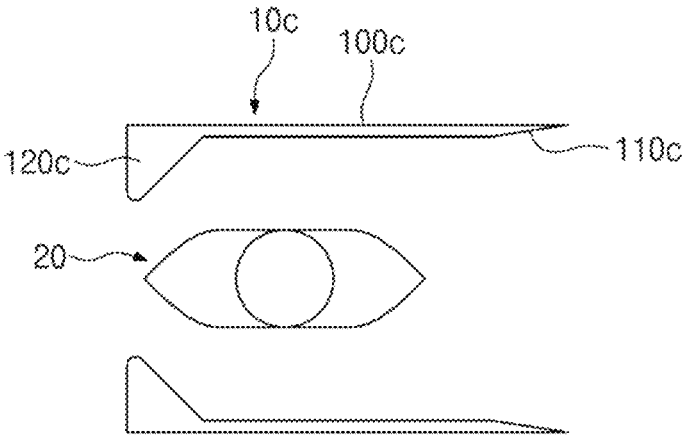

FIGS. 8 to 10 are views showing modifications of the duct in the apparatus for discharging air according the first embodiment.

Referring to FIG. 8, the duct 10*a* includes passage portions 100*a*, inlet portions 110*a*, and skin portions 120*a*.

The inlet portions 110*a* are positioned at rear end areas in the forward and backward directions. The areas facing each other in the inlet portions 110*a* protrude in the facing direction, in which a distance at which facing surfaces of the inlet portions 110*a* are spaced apart from each other may be smaller than a distance at which facing surfaces of the passage portions 100*a* are spaced apart from each other. The surfaces facing each other in the inlet portions 110*a* may be formed to be concave and rounded.

Since the passage portions 100*a* and the skin portions 120*a* are the same as the above-described embodiment, repeated descriptions will be omitted.

Referring to FIG. 9, the inlet portions 110*b* may be formed with the passage portions 100*b* side by side in the forward and backward directions. Since the passage portions 100*b* and the skin portions 120*b* are the same as the above-described embodiment, repeated descriptions will be omitted.

Referring to FIG. 10, the inlet portions 110*c* may be gradually inclined in a direction opposite to the direction facing each other as extending backward. Since the passage portions 100*c* and the skin portions 120*c* are the same as the above-described embodiment, repeated descriptions will be omitted.

Figure 11:
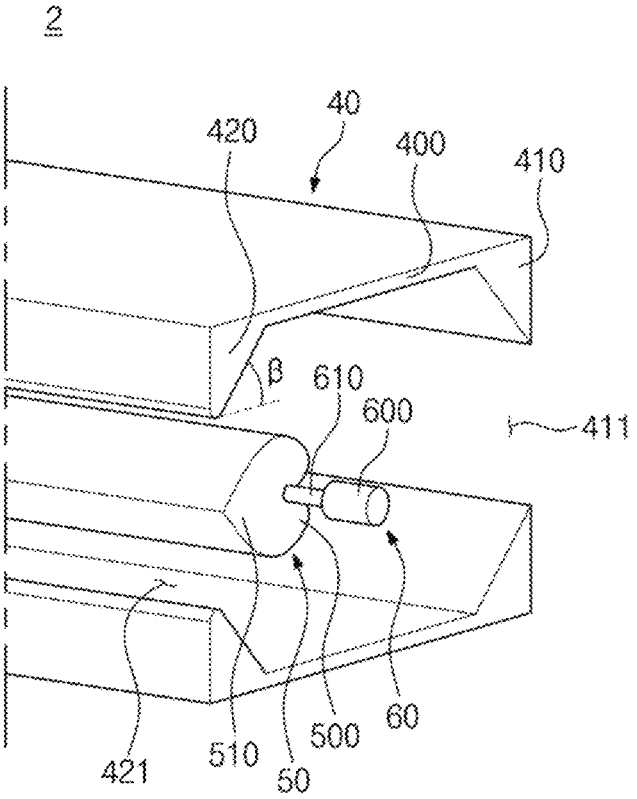
FIG. 11 is a view showing a left end of an apparatus for discharging air according to a second embodiment of the present invention.

FIG. 11 is a view showing a left end of an apparatus for discharging air according to a second embodiment of the present invention.

Side walls are omitted for convenience of illustrating the configuration positioned inside the duct 40.

Referring to FIG. 11, the apparatus 2 for discharging air according to the second embodiment of the present invention includes a duct 40, a wind direction control member 50, and a drive member 60.

The duct 40 includes passage portions 400, inlet portions 410, and skin portions 420. Since the structure of the duct 40 and the skin inclination angle β of the skin surface correspond to the duct 10 of the apparatus 1 for discharging air according to the first embodiment of FIG. 1, repeated descriptions will be omitted.

The wind direction control member 50 is positioned inside the duct 40, rotatable about a rotation shaft 610 provided in the lateral direction, and having at least a partial area moving in the vertical direction to control the direction of the air discharged through the outlet 421. The wind direction control member 50 may be provided to have at least a partial area positioned between the skin portions 420 in the forward and backward directions. The width in the lateral direction of the wind direction control member 50 may be formed to correspond to the width in the lateral direction of the internal space of the duct 40. The rotation shaft 610 of the wind direction control member 50 may be rotatably connected to the inside of the duct 40. As an example, the rotation shaft 610 of the wind direction control member 50 may be rotatably inserted into the side walls 130.

The wind direction control member 50 includes an inlet-side control portion 500 and an outlet-side control portion 510.

The inlet-side control portion 500 is positioned in the rear area of the wind direction control member 50 with respect to the rotation shaft 610. The inlet-side control portion 500 may be formed to have rounded upper and lower ends. The rear end area of the inlet-side control portion 500 may have a shape concave toward the rotation shaft 610. The inlet-side control portion 500 may have a shape in which upper and lower areas are symmetrical to each other based on a reference line in the forward and backward directions. In addition, the inlet-side control portion 500 may have a shape in which upper and lower areas are asymmetrical to each other based on a reference line in the forward and backward directions.

The outlet-side control portion 510 is positioned in the front area of the wind direction control member 50 with respect to the rotation shaft 610. The outlet-side control portion 510 may have at least a partial area positioned between the skin portions 420. A front-to-back length of the outlet-side control portion 510 based on the rotation shaft 610 is provided to be longer than a front-to-back length of the inlet-side control portion 500. The front-to-back length of the outlet-side control portion 510 based on the rotation shaft 610 may be provided to correspond to the shortest distance from the rotation shaft 610 to the skin surfaces of the skin portions 420. The outlet-side control portion 510 may have a thickness in the vertical direction smaller as extending forward. The outlet-side control portion 510 may be provided with rounded upper and lower ends. The outlet-side control portion 510 may have a front end tip so as to be formed sharply. The outlet-side control portion 510 may have a shape in which upper and lower areas are symmetrical to each other based on a reference line in the forward and backward directions. In addition, the outlet-side control portion 510 may have a shape in which upper and lower areas are asymmetrical to each other based on a reference line in the forward and backward directions.

The drive member 60 is connected to the wind direction control member 50 to provide a power for vertically moving at least a partial area of the wind direction control member 50. The drive member 60 may be positioned outside the duct 40 in the lateral direction. The drive member 60 is connected to the rotation shaft 610 to rotate the rotation shaft 610. As an example, the drive member 60 may be provided as a motor 600.

Figure 12:
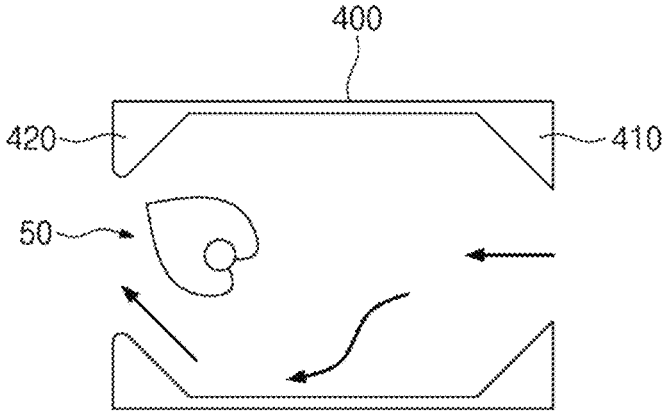
FIGS. 12 to 14 are views showing drive states of a wind direction control member when an upward wind is generated, a forward wind is generated, and a downward wind is generated in the apparatus for discharging air according to the second embodiment.
Figure 13:
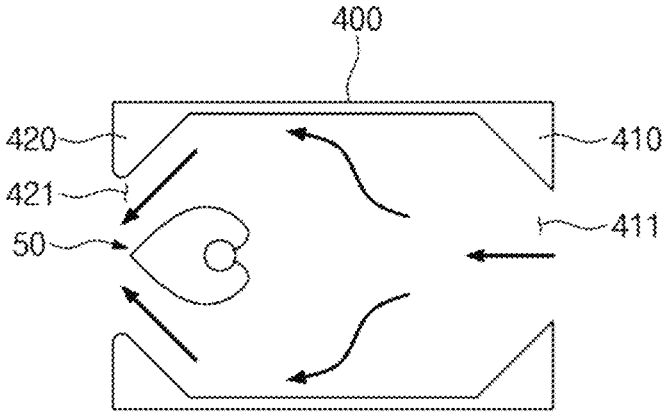
Figure 14:
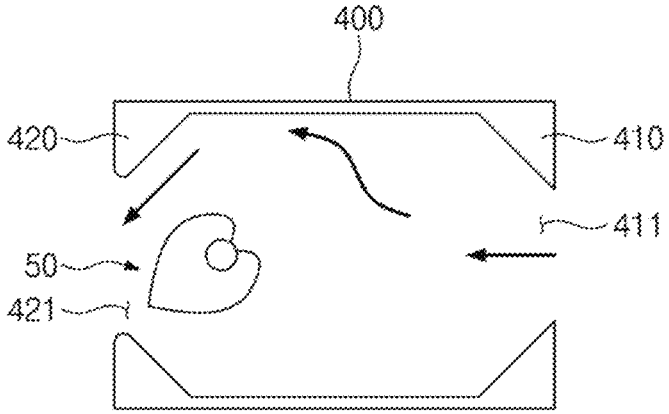

FIGS. 12 to 14 are views showing drive states of a wind direction control member when an upward wind is generated, a forward wind is generated, and a downward wind is generated in the apparatus for discharging air according to the second embodiment.

Referring to FIGS. 12 to 14, the wind direction discharged from the outlet 421 is controlled using the Coanda effect depending on the drive state of the wind direction control member 50.

Specifically, as shown in FIG. 12, when the inlet-side control portion 500 maximally rotates downward and the outlet-side control portion 510 is adjacent to the skin surface, the air flowing into the inside of the duct 40 through the inlet 411 is blocked or minimized from flowing into a space above the wind direction control member 50 and flows into a space below the wind direction control member 50 while the Coanda effect occurs. Thereafter, the flow direction of the air is guided by the outlet-side control portion 510 and the skin surfaces and the Coanda effect occurs, so that the air is discharged from the outlet 421 upward.

In addition, as shown in FIG. 13, when a lengthwise direction of the wind direction control member 50 is positioned to be directed to the forward and afterward directions, the air flowing into the inside of the duct 40 through the inlet 411 flows into the spaces above and below the wind direction control member 50 while the Coanda effect occurs. Thereafter, the flow direction of the air is guided by the outlet-side control portion 510 and the skin surfaces and the Coanda effect occurs, so that the air flowing through the space above the wind direction control member 50 and the air flowing therebelow are discharged forward from the outlet 421.

In addition, as shown in FIG. 14, when the inlet-side control portion 500 maximally rotates upward and the outlet-side control portion 510 is adjacent to the skin surface, the air flowing into the inside of the duct 40 through the inlet 411 is blocked or minimized from flowing into the space below the wind direction control member 50 and flows into the space above the wind direction control member 50 while the Coanda effect occurs. Thereafter, the flow direction of the air is guided by the outlet-side control portion 510 and the skin surfaces and the Coanda effect occurs, so that the air is discharged from the outlet 421 downward.

In addition, when the rotation degree of the inlet-side control portion 500 upward or downward is controlled, the air flowing in the spaces above and below the wind direction control member 50 is discharged to the outlet 421 in a controlled state, so that the wind direction may be formed at any angle between the upward wind and the forward wind according to FIG. 12, and at any angle between the downward wind and the forward wind according to FIG. 14. In addition, when the skin inclination angle β, the inclination degree of the upper and lower parts with respect to the front-back reference line of the outlet-side control portion 510, and the thickness thereof are designed to be controlled, the inclination of the discharged air may be more precisely controlled in a desired form.

Figure 15:
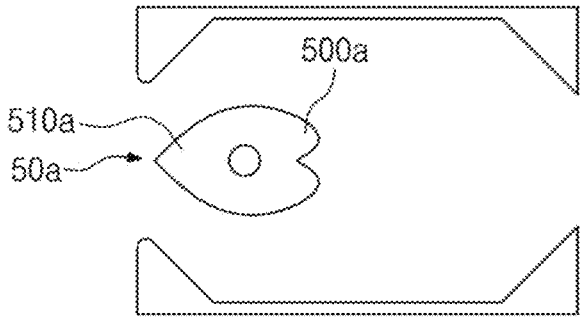
FIGS. 15 to 17 are views showing modifications of a wind direction control member in the apparatus for discharging air according to the second embodiment.
Figure 16:
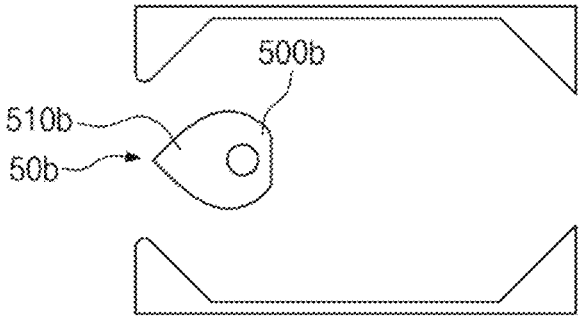
Figure 17:
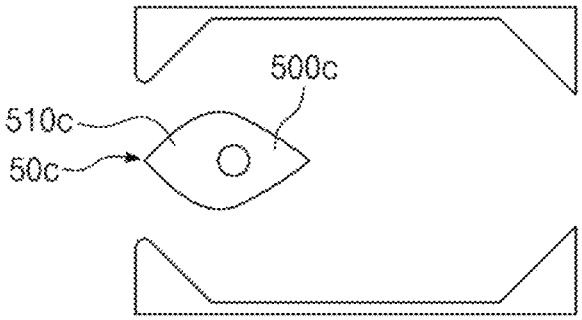

FIGS. 15 to 17 are views showing modifications of the wind direction control member in the apparatus for discharging air according the second embodiment.

Referring to FIG. 15, the wind direction control member 50*a* includes an inlet-side control portion 500*a* and an outlet-side control portion 510*a*. The front-to-back length of the outlet-side control portion 510*a* based on the rotation shaft 610 may correspond to the front-to-back length of the inlet-side control portion 500*a*.

Referring to FIG. 16, the wind direction control member 50*b* includes an inlet-side control portion 500*b* and an outlet-side control portion 510*b*. A rear end of the inlet-side control portion 500*b* may be provided linearly in the vertical direction.

Referring to FIG. 17, the wind direction control member 50*c* includes an inlet-side control portion 500*c* and an outlet-side control portion 510*c*. The inlet-side control portion 500*c* may a thickness in the vertical direction smaller as extending backward. The inlet-side control portion 500*c* may have a rear end so as to be formed sharply.

Figure 18:
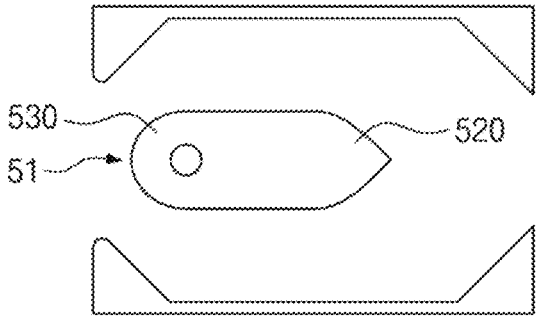
FIG. 18 is a view showing a wind direction control member according to a second embodiment in the apparatus for discharging air according to the second embodiment.

FIG. 18 is a view showing a wind direction control member according to the second embodiment in the apparatus for discharging air according the second embodiment.

Referring to FIG. 18, the wind direction control member 51 includes an inlet-side control portion 520 and an outlet-side control portion 530.

The inlet-side control portion 520 is positioned in a rear area of the wind direction control member 51 with respect to the rotation shaft 610. The inlet-side control portion 520 may have a rear area having a thickness in the vertical direction smaller as extending backward. The rear area of the inlet-side control portion 520 may be formed to be rounded. The inlet-side control portion 520 may have a rear end so as to be formed sharply. The front-to-back length of the inlet-side control portion 520 based on the rotation shaft 610 may be greater than or equal to a separation distance in the vertical direction from the rotation shaft 610 to the passage portions 400. The inlet-side control portion 520 may have a shape in which upper and lower areas are symmetrical to each other based on a reference line in the forward and backward directions. In addition, the inlet-side control portion 520 may have a shape in which upper and lower areas are asymmetrical to each other based on a reference line in the forward and backward directions.

The outlet-side control portion 530 is positioned in the front area of the wind direction control member 51 with respect to the rotation shaft 610. The outlet-side control portion 530 may have at least a partial area positioned between the skin portions 420. A front-to-back length of the outlet-side control portion 530 based on the rotation shaft 610 is provided to be shorter than a front-to-back length of the inlet-side control portion 520. The front-to-back length of the outlet-side control portion 530 based on the rotation shaft 610 is provided to be shorter than the shortest distance from the rotation shaft 610 to the skin surfaces of the skin portions 420. The outlet-side control portion 530 may have a thickness in the vertical direction smaller as extending forward. The outlet-side control portion 530 may be provided to be rounded. A front end tip of the outlet-side control portion 530 may be formed to be rounded. The outlet-side control portion 530 may have a shape in which upper and lower areas are symmetrical to each other based on a reference line in the forward and backward directions. In addition, the outlet-side control portion 530 may have a shape in which upper and lower areas are asymmetrical to each other based on a reference line in the forward and backward directions.

Figure 19:
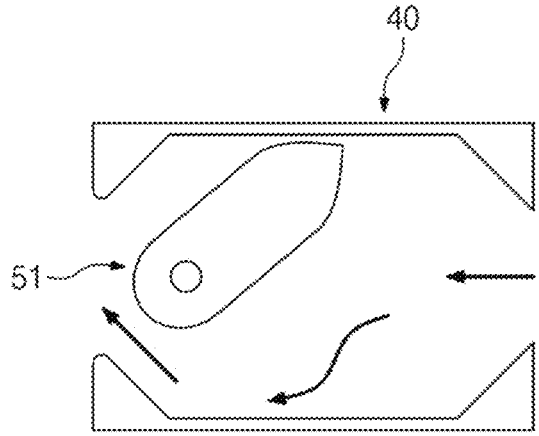
FIG. 19 is a view showing a drive state of the wind direction control member when an upward wind is generated in the apparatus for discharging air according to FIG. 18.

FIG. 19 is a view showing a drive state of the wind direction control member when an upward wind is generated in the apparatus for discharging air according to FIG. 18.

Referring to FIG. 19, when the inlet-side control portion 520 maximally rotates upward and is adjacent to an inner side surface of the duck 40, the air flowing into the inside of the duct 40 through the inlet 411 is blocked or minimized from flowing into a space above the wind direction control member 51 and flows into a space below the wind direction control member 51 while the Coanda effect occurs. Thereafter, the flow direction of the air is guided by the outlet-side control portion 530 and the skin surfaces and the Coanda effect occurs, so that the air is discharged from the outlet 421 upward.

Similarly, when the inlet-side control portion 520 maximally rotates downward and is adjacent to the inner side surface of the duck 40, the air flowing into the inside of the duct 40 through the inlet 411 is blocked or minimized from flowing into the space below the wind direction control member 51 and flows into the space above the wind direction control member 51 while the Coanda effect occurs. Thereafter, the flow direction of the air is guided by the outlet-side control portion 530 and the skin surfaces and the Coanda effect occurs, so that the air is discharged from the outlet 421 downward.

Figure 20:
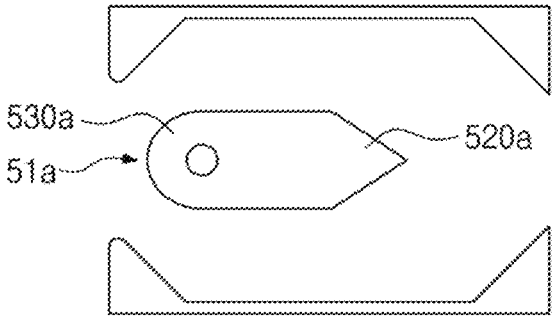
FIGS. 20 to 22 are views showing modifications of the wind direction control member according to FIG. 18.
Figure 21:
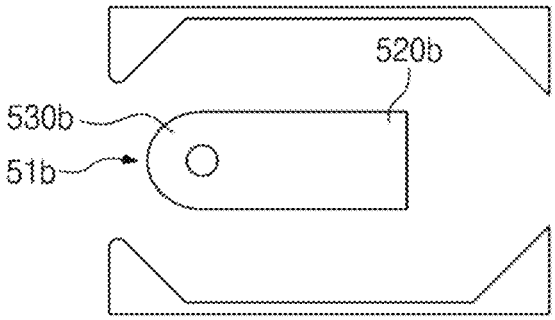
Figure 22:
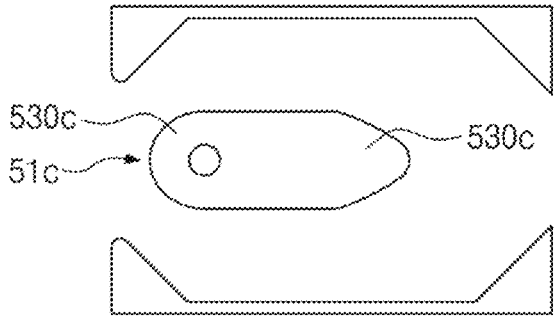

In addition, when a lengthwise direction of the wind direction control member 51 is positioned to be directed to the forward and afterward directions, the air flowing into the inside of the duct 40 through the inlet 411 flows into the spaces above and below the wind direction control member 51 while the Coanda effect occurs. Thereafter, the flow direction of the air is guided by the outlet-side control portion 530 and the skin surfaces and the Coanda effect occurs, so that the air flowing through the space above the wind direction control member 51 and the air flowing therebelow are discharged forward from the outlet 421. FIGS. 20 to 22 are views showing modifications of the wind direction control member according to FIG. 18.

Referring to FIG. 20, the wind direction control member 51*a* includes an inlet-side control portion 520*a* and an outlet-side control portion 530*a*. The inlet-side control portion 520*a* may have a rear area having a thickness in the vertical direction smaller as extending backward. The inlet-side control portion 520*a* may have a rear end so as to be formed sharply. The rear area of the inlet-side control portion 520*a* may be provided in a triangular shape.

Referring to FIG. 21, the wind direction control member 51*b* includes an inlet-side control portion 520*b* and an outlet-side control portion 530*b*. A rear area of the inlet-side control portion 520*b* may be provided in a rectangular shape.

Referring to FIG. 22, the wind direction control member 51*c* includes an inlet-side control portion 520*c* and an outlet-side control portion 530*c*. The inlet-side control portion 520*c* may have a rear area having a thickness in the vertical direction smaller as extending backward. The rear area and a rear end of the inlet-side control portion 520*c* may be provided to be rounded.

Figure 23:
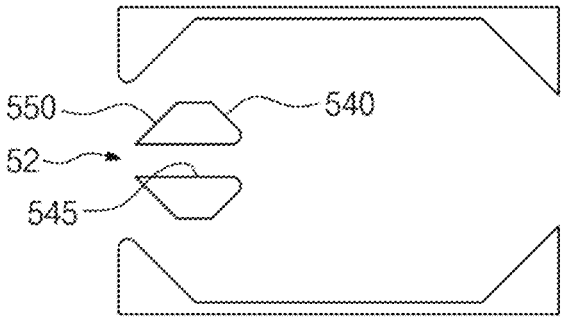
FIG. 23 is a view showing a wind direction control member according to a third embodiment in the apparatus for discharging air according to the second embodiment.

FIG. 23 is a view showing a wind direction control member according to a third embodiment in the apparatus for discharging air according the second embodiment.

Referring to FIG. 23, the wind direction control member 52 is formed in a central area in the vertical direction thereof with a flow hole 545 formed through in the forward and backward directions. The flow hole 545 may be formed over at least a partial area of the wind direction control member 52 in the lateral direction.

The wind direction control member 52 includes an inlet-side control portion 540 and an outlet-side control portion 550.

The inlet-side control portion 540 is positioned in a rear area of the wind direction control member 52 with respect to the rotation shaft 610. The inlet-side control portion 540 may have a rear area having a thickness in the vertical direction smaller as extending backward. The area adjacent to the flow hole 545 at the rear end of the inlet-side control portion 540 may be formed to be rounded.

The outlet-side control portion 550 is positioned in the front area of the wind direction control member 52 with respect to the rotation shaft 610. The outlet-side control portion 550 may have at least a partial area positioned between the skin portions 420. A front-to-back length of the outlet-side control portion 550 based on the rotation shaft 610 is provided to be longer than a front-to-back length of the inlet-side control portion 540. The front-to-back length of the outlet-side control portion 550 based on the rotation shaft 610 may be provided to correspond to the shortest distance from the rotation shaft 610 to the skin surfaces of the skin portions 420. The outlet-side control portion 550 may have a front area having a thickness in the vertical direction smaller as extending forward. The front area of the outlet-side control portion 550 may be provided in a triangular shape.

Figure 24:
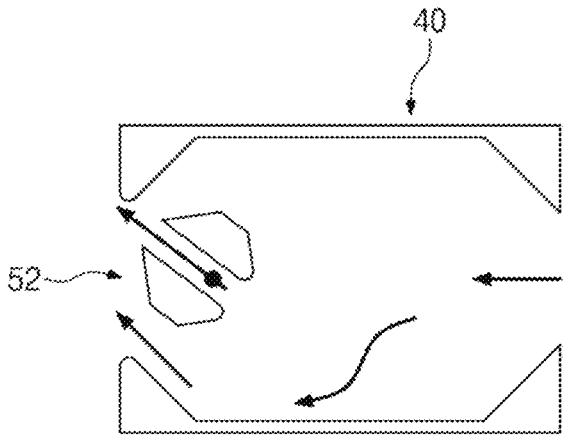
FIG. 24 is a view showing a drive state of the wind direction control member when an upward wind is generated in the apparatus for discharging air according to FIG. 23.

FIG. 24 is a view showing a drive state of the wind direction control member when an upward wind is generated in the apparatus for discharging air according to FIG. 23.

Referring to FIG. 24, when the inlet-side control portion 540 maximally rotates downward and the outlet-side control portion 550 is adjacent to the skin surface, the air flowing into the inside of the duct 40 through the inlet 411 is blocked or minimized from flowing into a space above the wind direction control member 52 and flows into a space below the wind direction control member 52 while the Coanda effect occurs. Thereafter, the flow direction of the air is guided by the outlet-side control portion 550 and the skin surfaces and the Coanda effect occurs, so that the air is discharged from the outlet 421 upward. In addition, some of the air flowing into the duct 40 passes through the flow hole 545 and is then discharged upward.

Similarly, when the inlet-side control portion 540 maximally rotates upward, the air is discharged from the outlet 421 downward.

In addition, when a lengthwise direction of the wind direction control member 52 is positioned to be directed to the front-to-rear direction, the air is discharged from the outlet 421 forward.

Figure 25:
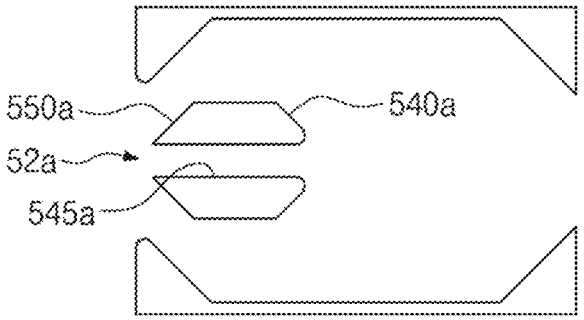
FIGS. 25 to 27 are views showing modifications of the wind direction control member according to FIG. 23.
Figure 26:
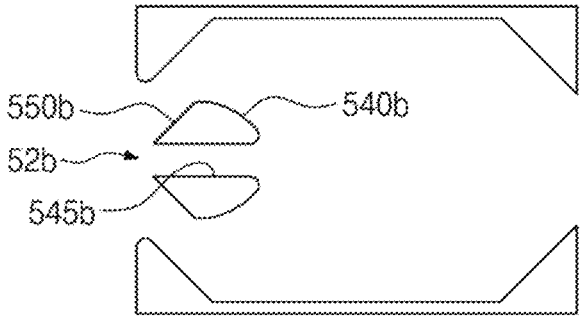
Figure 27:
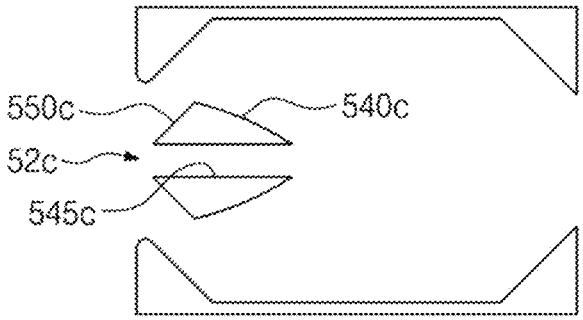

FIGS. 25 to 27 are views showing modifications of the wind direction control member according to FIG. 23. Referring to FIG. 25, the wind direction control member 52*a* is formed in a central area in the vertical direction thereof with a flow hole 545*a* formed through in the forward and backward directions.

The wind direction control member 52*a* includes an inlet-side control portion 540*a* and an outlet-side control portion 550*a*. A front-to-back length of the inlet-side control portion 540*a* may correspond to a front-to-back length of the outlet-side control portion 550*a*.

Referring to FIG. 26, the wind direction control member 52*b* is formed in a central area in the vertical direction thereof with a flow hole 545*b* formed through in the forward and backward directions.

The wind direction control member 52*b* includes an inlet-side control portion 540*b* and an outlet-side control portion 550*b*. The inlet-side control portion 540*b* may be provided in a round shape with a vertical thickness smaller as extending backward.

Referring to FIG. 27, the wind direction control member 52*c* is formed in a central area in the vertical direction thereof with a flow hole 545*c* formed through in the forward and backward directions. The wind direction control member 50*c* includes an inlet-side control portion 540*c* and an outlet-side control portion 550*c*.

The inlet-side control portion 540*c* may be provided in a round shape with a vertical thickness smaller as extending backward. The inlet-side control portion 540*c* may have a rear end so as to be formed sharply.

Figure 28:
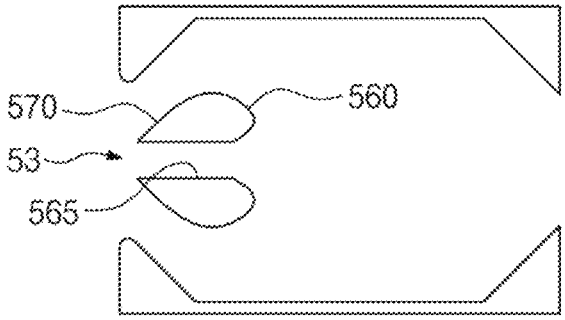
FIG. 28 is a view showing a wind direction control member according to a fourth embodiment in the apparatus for discharging air according to the second embodiment.

FIG. 28 is a view showing a wind direction control member according to a fourth embodiment in the apparatus for discharging air according the second embodiment.

Referring to FIG. 28, the wind direction control member 53 is formed in a central area in the vertical direction thereof with a flow hole 565 formed through in the forward and backward directions. The flow hole 565 may be formed over at least a partial area of the wind direction control member 53 in the lateral direction.

The wind direction control member 53 includes an inlet-side control portion 560 and an outlet-side control portion 570.

The inlet-side control portion 560 is positioned in a rear area of the wind direction control member 53 with respect to the rotation shaft 610. The inlet-side control portion 560 may have a rear area having a thickness in the vertical direction smaller as extending backward. The area adjacent to the flow hole 565 at the rear end of the inlet-side control portion 560 may be concave toward the flow hole 565.

The outlet-side control portion 570 is positioned in the front area of the wind direction control member 53 with respect to the rotation shaft 610. The outlet-side control portion 570 may have at least a partial area positioned between the skin portions 420. A front-to-back length of the outlet-side control portion 570 based on the rotation shaft 610 is provided to be longer than a front-to-back length of the inlet-side control portion 560. The front-to-back length of the outlet-side control portion 570 based on the rotation shaft 610 may be provided to correspond to the shortest distance from the rotation shaft 610 to the skin surfaces of the skin portions 420. The outlet-side control portion 570 may have a front area having a thickness in the vertical direction smaller as extending forward. The front area of the outlet-side control portion 570 may be provided to be rounded.

Figure 29:
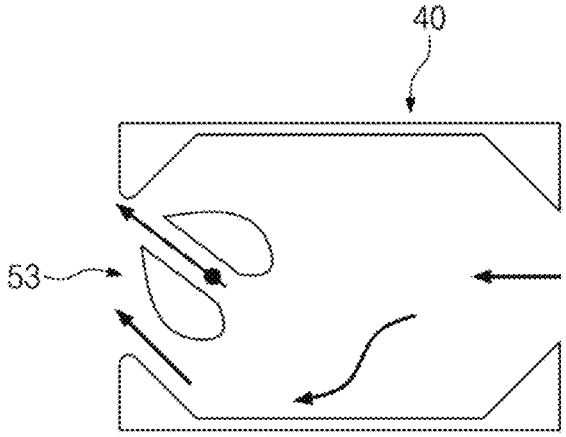
FIG. 29 is a view showing a drive state of the wind direction control member when an upward wind is generated in the apparatus for discharging air according to FIG. 28.

FIG. 29 is a view showing a drive state of the wind direction control member when an upward wind is generated in the apparatus for discharging air according to FIG. 28.

Referring to FIG. 29, when the inlet-side control portion 560 maximally rotates downward and the outlet-side control portion 570 is adjacent to the skin surface, the air flowing into the inside of the duct 40 through the inlet 411 is blocked or minimized from flowing into a space above the wind direction control member 53 and flows into a space below the wind direction control member 53 while the Coanda effect occurs. Thereafter, the flow direction of the air is guided by the outlet-side control portion 570 and the skin surfaces and the Coanda effect occurs, so that the air is discharged from the outlet 421 upward. In addition, some of the air flowing into the duct 40 passes through the flow hole 565 and is then discharged upward.

Similarly, when the inlet-side control portion 560 maximally rotates upward, the air is discharged from the outlet 421 downward.

In addition, when a lengthwise direction of the wind direction control member 53 is positioned to be directed to the front-to-rear direction, the air is discharged from the outlet 421 forward.

Figure 30:
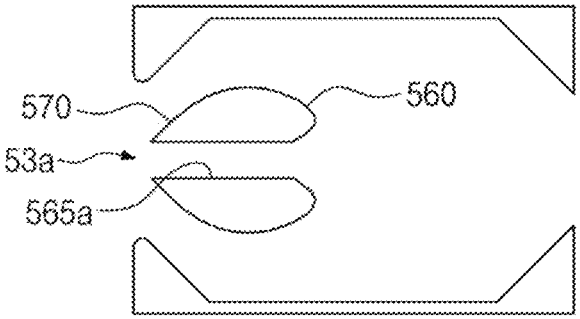
FIGS. 30 to 32 are views showing modifications of the wind direction control member according to FIG. 28.
Figure 31:
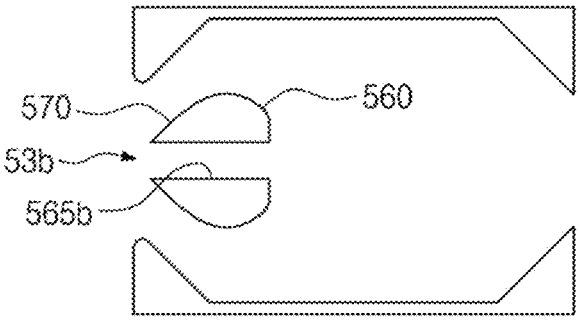
Figure 32:
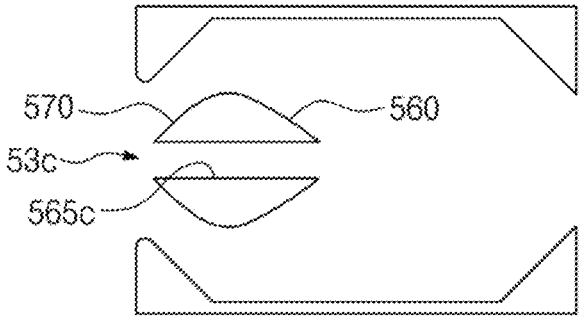

FIGS. 30 to 32 are views showing modifications of the wind direction control member according to FIG. 28.

Referring to FIG. 30, the wind direction control member 53*a* is formed in a central area in the vertical direction thereof with a flow hole 565*a* formed through in the forward and backward directions.

The wind direction control member 53*a* includes an inlet-side control portion 560*a* and an outlet-side control portion 570*a*. A front-to-back length of the inlet-side control portion 560*a* may correspond to a front-to-back length of the outlet-side control portion 570*a*.

Referring to FIG. 31, the wind direction control member 53*b* is formed in a central area in the vertical direction thereof with a flow hole 565*b* formed through in the forward and backward directions.

The wind direction control member 53*b* includes an inlet-side control portion 560*b* and an outlet-side control portion 570*b*.

A rear end of the inlet-side control portion 560*b* may be provided linearly in the vertical direction.

Referring to FIG. 32, the wind direction control member 53*c* is formed in a central area in the vertical direction thereof with a flow hole 565*c* formed through in the forward and backward directions. The wind direction control member 53*c* includes an inlet-side control portion 560*c* and an outlet-side control portion 570*c*.

The inlet-side control portion 560*c* may be provided in a round shape with a vertical thickness smaller as extending backward. The inlet-side control portion 560*c* may have a rear end so as to be formed sharply.

Figure 33:
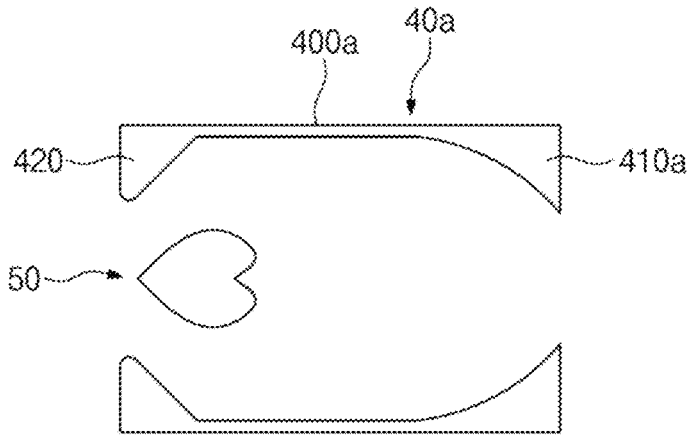
FIGS. 33 to 35 are views showing modifications of the duct in the apparatus for discharging air according the second embodiment.
Figure 34:
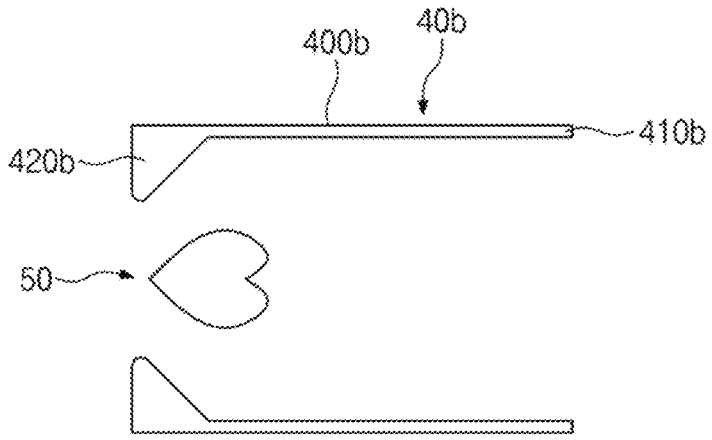
Figure 35:
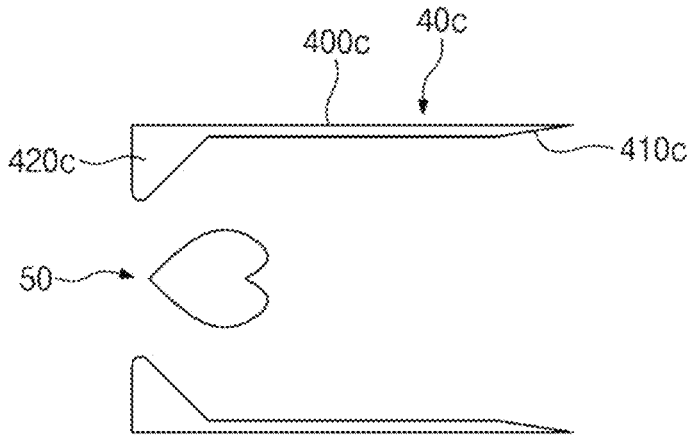

FIGS. 33 to 35 are views showing modifications of the duct in the apparatus for discharging air according the second embodiment.

Referring to FIG. 33, the duct 40*a* includes passage portions 400*a*, inlet portions 410*a*, and skin portions 420*a*.

The inlet portions 410*a* are positioned at rear end areas in the forward and backward directions. The areas facing each other in the inlet portions 410*a* protrude in the facing direction, in which a distance at which facing surfaces of the inlet portions 410*a* are spaced apart from each other may be smaller than a distance at which facing surfaces of the passage portions 400*a* are spaced apart from each other. The surfaces facing each other in the inlet portions 410*a* may be formed to be concave and rounded.

Referring to FIG. 34, the duct 40*b* includes passage portions 400*b*, inlet portions 410*b*, and skin portions 420*b*. The inlet portions 410*b* may be formed with the passage portions 400*b* side by side in the forward and backward directions.

Referring to FIG. 35, the duct 40*c* includes passage portions 400*c*, inlet portions 410*c*, and skin portions 420*c*. The inlet portions 410*c* may be gradually inclined in a direction opposite to the direction facing each other as extending backward.

Figure 36:
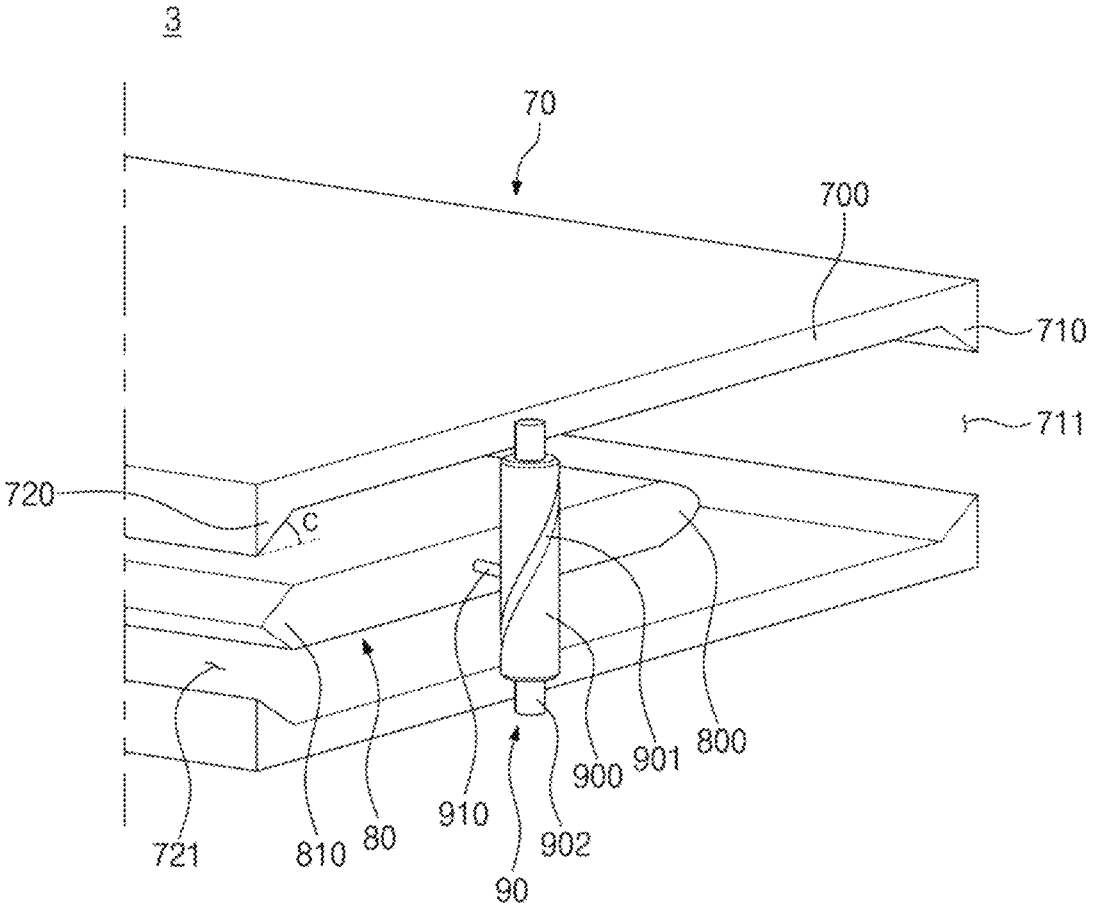
FIG. 36 is a view showing a left end of an apparatus for discharging air according to a third embodiment of the present invention.

FIG. 36 is a view showing a left end of an apparatus for discharging air according to the third embodiment of the present invention.

Side walls are omitted for convenience of illustrating the configuration positioned inside the duct 70.

Referring to FIG. 36, the apparatus 3 for discharging air according to the third embodiment of the present invention includes a duct 70, a wind direction control member 80, and a drive member 90.

The duct 70 includes passage portions 700, inlet portions 710, and skin portions 720. Since the structure of the duct 70 and the skin inclination angle c of the skin surface correspond to the duct 10 of the apparatus 1 for discharging air according to the first embodiment of FIG. 1, repeated descriptions will be omitted.

The wind direction control member 80 is positioned inside the duct 70 and moves in the vertical direction to control the direction of air discharged through the outlet 721. The wind direction control member 80 may be provided to have at least a partial area positioned between the skin portions 720 in the forward and backward directions. The width in the lateral direction of the wind direction control member 80 may be formed to correspond to the width in the lateral direction of an internal space of the duct 70.

The wind direction control member 80 includes an inlet-side control portion 800, an outlet-side control portion 810, and a connection portion 820.

The inlet-side control portion 800 is positioned in a rear area of the wind direction control member 80. The inlet-side control portion 800 may a thickness in the vertical direction smaller as extending backward. The inlet-side control portion 800 may be formed in a round shape. A rear end of the inlet-side control portion 800 may be provided to be rounded. The inlet-side control portion 800 may have a shape in which upper and lower areas are symmetrical to each other based on a reference line in the forward and backward directions. In addition, the inlet-side control portion 800 may have a shape in which upper and lower areas are asymmetrical to each other based on a reference line in the forward and backward directions.

The outlet-side control portion 810 is positioned in a front area of the wind direction control member 80. The outlet-side control portion 810 may have at least a partial area positioned between the skin portions 720. The outlet-side control portion 810 may have a thickness in the vertical direction smaller as extending forward. The outlet-side control portion 810 may have a front end tip so as to be formed sharply. The outlet-side control portion 810 may be provided in a triangular shape. The outlet-side control portion 810 may have a shape in which upper and lower areas are symmetrical to each other based on a reference line in the forward and backward directions. In addition, the outlet-side control portion 810 may have a shape in which upper and lower areas are asymmetrical to each other based on a reference line in the forward and backward directions.

The connection portion 820 is positioned between the inlet-side control portion 800 and the outlet-side control portion 810. The connection portion 820 may be provided as a plate structure having a preset thickness vertically.

A drive member 90 is connected to the wind direction control member 80 to provide a power for vertically moving the wind direction control member 80. The drive member 90 may be positioned outside the duct 70 in the lateral direction. The drive member 90 may be provided as a drive cam 900 (Cam). The drive cam 900 is connected to a cam drive shaft 902 having a lengthwise direction provided in the vertical direction so as to be rotatable about an axis in the vertical direction. The drive cam 900 may be provided as a cylinder, and formed on an outer surface thereof with a cam groove 901. A connection shaft 910 coupled to a lateral side of the wind direction control member 80 may extend outward in the lateral direction, and an outer end of the connection shaft 910 may be positioned to be inserted into the cam groove 901. When the drive cam 900 rotates, the connection shaft 910 moves along a trajectory in the vertical direction, and accordingly the wind direction control member 80 moves in the vertical direction. The side wall (not shown) may be disposed therein with the connection shaft 910, and formed therein with a communication hole (not shown) having a shape corresponding to the trajectory on which the connection shaft 910 moves.

Figure 37:
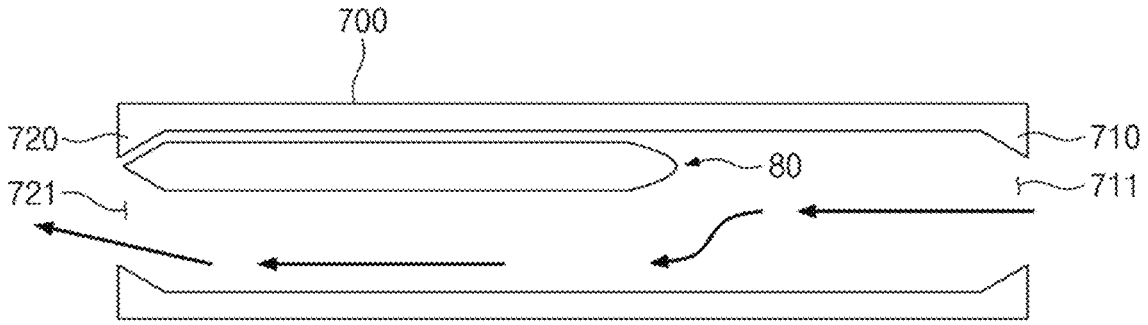
FIGS. 37 to 39 are views showing drive states of a wind direction control member when an upward wind is generated, a forward wind is generated, and a downward wind is generated in the apparatus for discharging air according to the third embodiment.
Figure 38:
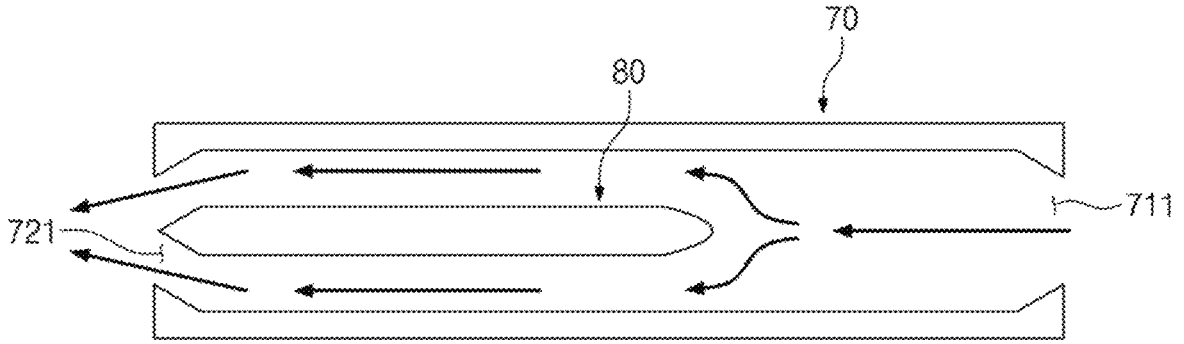
Figure 39:
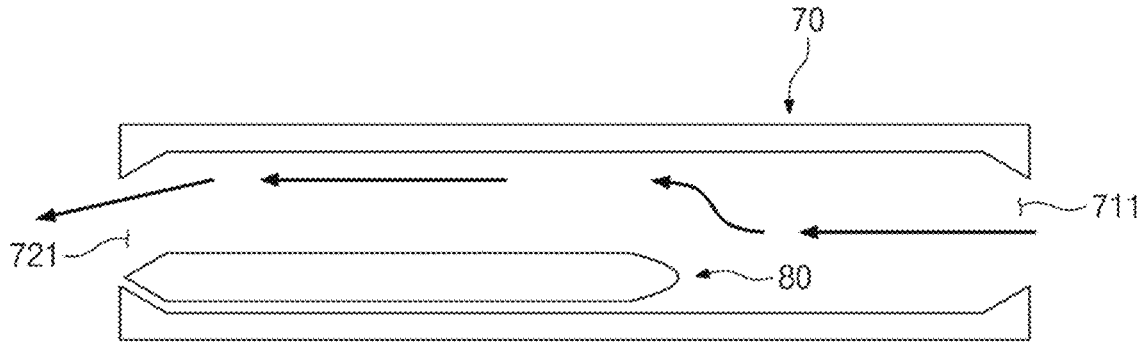

FIGS. 37 to 39 are views showing drive states of the wind direction control member when an upward wind is generated, a forward wind is generated, and a downward wind is generated in the apparatus for discharging air according to the third embodiment.

Referring to FIGS. 37 to 39, the wind direction discharged from the outlet is controlled using the Coanda effect depending on the drive state of the wind direction control member.

Specifically, as shown in FIG. 37, when the wind direction control member 80 maximally rotates upward, the air flowing into the inside of the duct 70 through the inlet 711 is minimized or blocked from flowing into a space above the wind direction control member 80 and flows into a space below the wind direction control member 80 while the Coanda effect occurs. Thereafter, the flow direction of the air is guided by the outlet-side control portion 810 and the skin surfaces and the Coanda effect occurs, so that the air is discharged from the outlet 721 upward.

In addition, as shown in FIG. 38, when the wind direction control member 80 is positioned in a center area of the internal space of the duct 70 in the vertical direction, the air flowing into the inside of the duct 70 through the inlet 711 flows into the spaces above and below the wind direction control member 80 while the Coanda effect occurs. Thereafter, the flow direction of the air is guided by the outlet-side control portion 810 and the skin surfaces and the Coanda effect occurs, so that the air flowing through the space above the wind direction control member 80 and the air flowing therebelow are discharged forward from the outlet 721.

In addition, as shown in FIG. 39, when the wind direction control member 80 maximally rotates downward, the air flowing into the inside of the duct 70 through the inlet 711 is minimized or blocked from flowing into the space below the wind direction control member 80 and flows into the space above the wind direction control member 80 while the Coanda effect occurs. Thereafter, the flow direction of the air is guided by the outlet-side control portion 810 and the skin surfaces and the Coanda effect occurs, so that the air is discharged from the outlet 721 downward.

In addition, when the moving degree of the wind direction control member 80 upward or downward is controlled, the air flowing in the space above and below the wind direction control member 80 are discharged through the outlet 721 in a controlled state, so that the wind direction may be formed at any angle between the upward wind and the forward wind according to FIG. 37, and at any angle between the downward wind and the forward wind according to FIG. 39. In addition, when the skin inclination angle c, the inclination degree of the upper and lower parts with respect to the front-back reference line of the outlet-side control portion 810, and the thickness thereof are designed to be controlled, the inclination of the discharged air may be more precisely controlled in a desired form.

Figure 40:
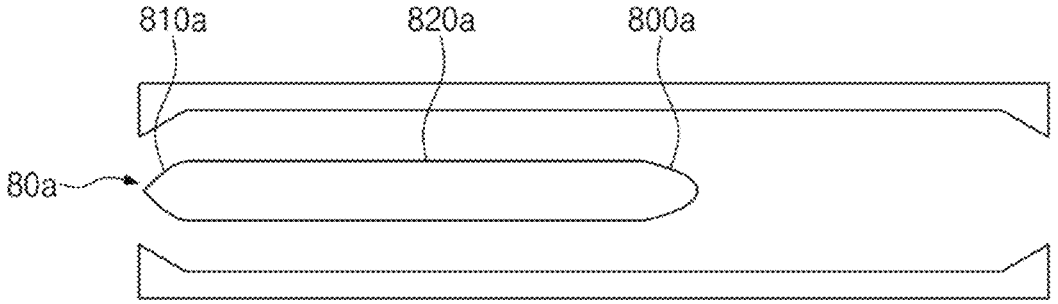
FIGS. 40 and 41, are views showing modifications of the wind direction control member in the apparatus for discharging air according to the third embodiment.
Figure 41:
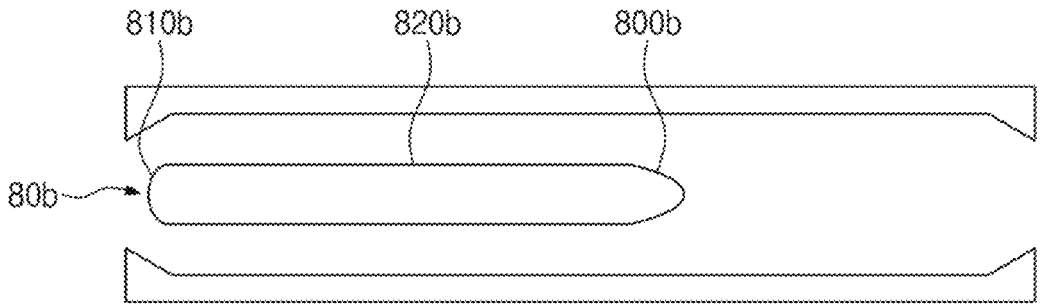

FIGS. 40 to 41 are views showing modifications of the wind direction control member in the apparatus for discharging air according the third embodiment.

Referring to FIG. 40, the wind direction control member 80*a* includes an inlet-side control portion 800*a*, an outlet-side control portion 810*a*, and a connection portion 820*a*.

The outlet-side control portion 810*a* is positioned in a front area of the wind direction control member 80*a*. The outlet-side control portion 810*a* may have a thickness in the vertical direction smaller as extending forward. The outlet-side control portion 810*a* may be provided to be rounded. The outlet-side control portion 810*a* may have a front end tip so as to be formed sharply.

Referring to FIG. 41, the wind direction control member 80*b* includes an inlet-side control portion 800*b*, an outlet-side control portion 810*b*, and a connection portion 820*b*.

The outlet-side control portion 810*b* is positioned in a front area of the wind direction control member 80*b*. The outlet-side control portion 810*b* may have a thickness in the vertical direction smaller as extending forward. The outlet-side control portion 810*b* may be provided to be rounded. A front end tip of the outlet-side control portion 810*b* may be formed to be rounded.

Figure 42:
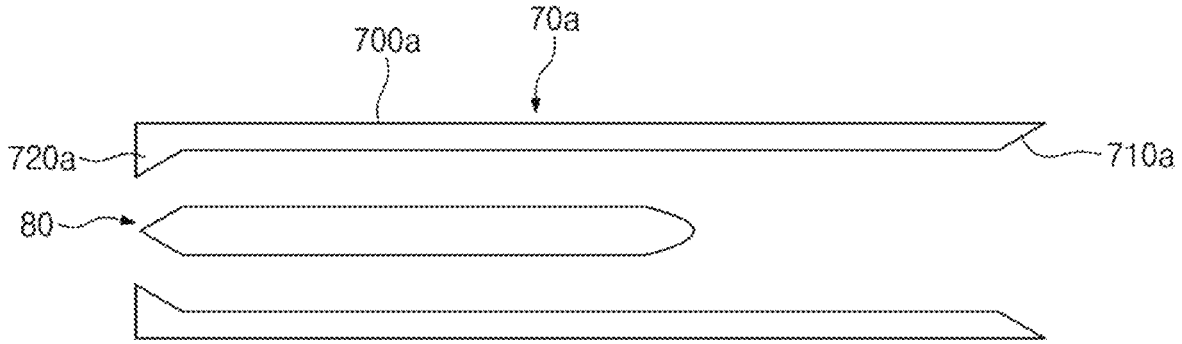
FIGS. 42 to 44 are views showing modifications of the duct in the apparatus for discharging air according to the third embodiment.
Figure 43:
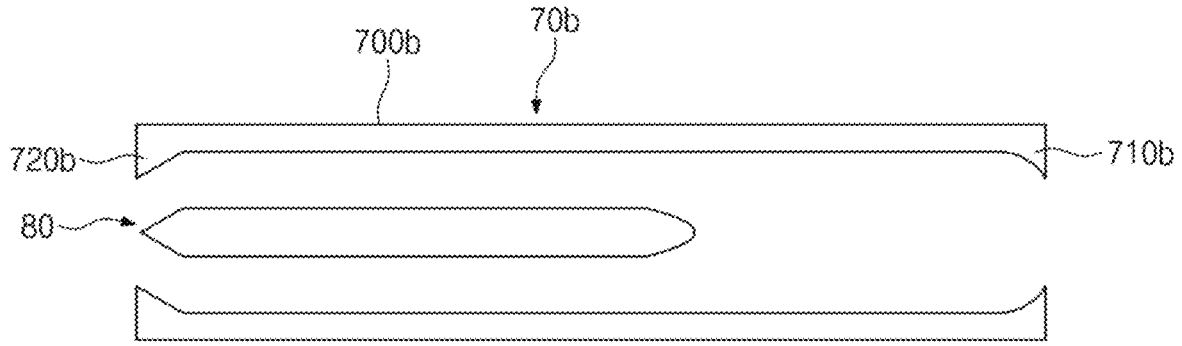
Figure 44:
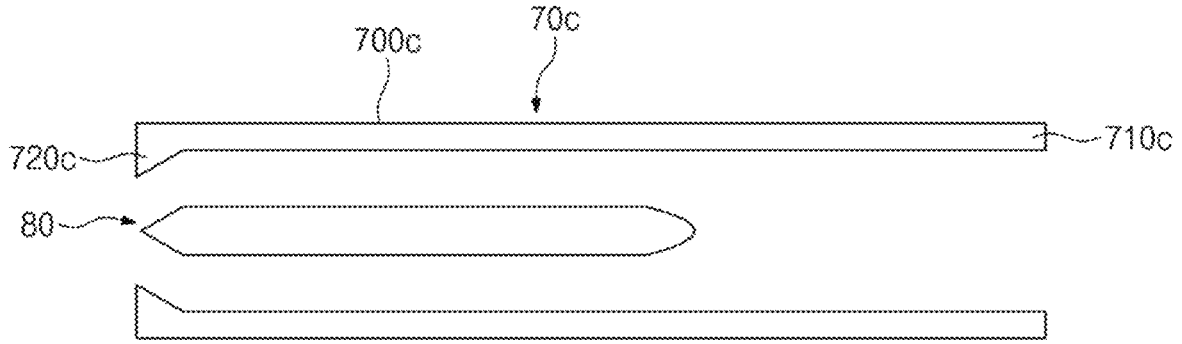

FIGS. 42 to 44 are views showing modifications of the duct in the apparatus for discharging air according the third embodiment.

Referring to FIG. 42, the duct 70*a* includes passage portions 700*a*, inlet portions 710*a*, and skin portions 720*a*.

The inlet portions 710*a* may be gradually inclined in a direction opposite to the direction facing each other as extending backward.

Referring to FIG. 43, the duct 70*b* includes passage portions 700*b*, inlet portions 710*b*, and skin portions 720*b*.

The inlet portions 710*b* are positioned at rear end areas in the forward and backward directions. The areas facing each other in the inlet portions 710*b* protrude in the facing direction, in which a distance at which facing surfaces of the inlet portions 710*b* are spaced apart from each other may be smaller than a distance at which facing surfaces of the passage portions 700*b* are spaced apart from each other. The surfaces facing each other in the inlet portions 710*b* may be formed to be concave and rounded.

Referring to FIG. 44, the duct 70*c* includes passage portions 700*c*, inlet portions 710*c*, and skin portions 720*c*.

The inlet portions 710*c* may be formed with the passage portions 700*c* side by side in the forward and backward directions.

Figure 45:
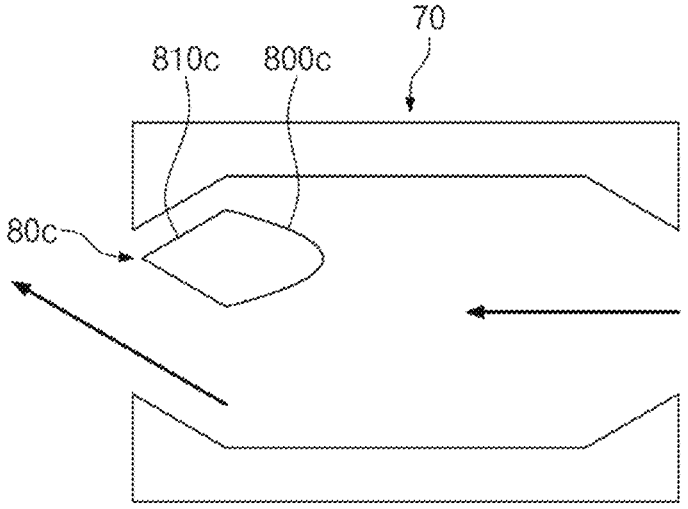
FIG. 45 is a view showing a wind direction control member according to the second embodiment in the apparatus for discharging air according to the third embodiment.

FIG. 45 is a view showing the wind direction control member according to the second embodiment in the apparatus for discharging air according the third embodiment.

Referring to FIG. 45, the wind direction control member 80*c* includes an inlet-side control portion 800*c* and an outlet-side control portion 810*c*.

The inlet-side control portion 800*c* is positioned in a rear area of the wind direction control member 80*c*. The inlet-side control portion 800*c* may a thickness in the vertical direction smaller as extending backward. The inlet-side control portion 800*c* may be formed in a round shape.

The outlet-side control portion 810*c* is positioned in the front area of the wind direction control member 80*c*. The outlet-side control portion 810*c* may have at least a partial area positioned between the skin portions 720*c*. The outlet-side control portion 810*c* may have a thickness in the vertical direction smaller as extending forward. The outlet-side control portion 810*c* is provided to be connected to a front end of the inlet-side control portion 800*c*.

Accordingly, even when the wind direction control member 80*c* is provided with the connection portion omitted and the front-to-back length is short compared to the embodiment according to FIG. 36, directions of the air discharged from the outlet 721 may be uniformly in the same way according to the vertical movements of the wind direction control member 80*c*.

According to the apparatuses 1, 2 and 3 for discharging air according to the present invention, the wind direction control members 20, 50 and 80 for controlling wind directions are positioned inside the ducts 10, 40 and 70, and thus a slim structure is shaped like a long bar in the lateral direction as a whole, so that the apparatuses 1, 2 and 3 for discharging air can be easily installed and the aesthetics in terms of design can be improved.

In addition, according to the apparatuses 1, 2 and 3 for discharging air according to the present invention, the direction of the wind is controlled through the wind direction control members 20, 50 and 80 using the Coanda effect, so that the direction of the wind can be finely controlled.

In addition, the skin inclination angles α, β and c of the skin surfaces, the vertical thickness of the inlet-side control portions in the wind direction control members 20, 50 and 80, the inclination degrees with respect to the centers of the inlet-side control portions 200, 500 and 800 in the forward and backward directions, the thickness in the vertical direction of the outlet-side control portions 210, 510 and 810, and the inclination degrees with respect to the centers of the outlet-side control portions 210, 510 and 810 in the forward and backward directions are controlled in regard to the ducts 10, 40 and 70, so that the wind can be discharged while the direction of the wind is finely controlled within the required range.

Although the present invention has been described in detail with reference to the preferred embodiments, the present invention is not limited to the specific embodiments and will be interpreted by the following claims. In addition, it will be apparent that a person having ordinary skill in the art may carry out various deformations and modifications for the embodiments described as above within the scope without departing from the present invention.

INDUSTRIAL APPLICABILITY

The apparatus for discharging air according to the present invention may be used in an apparatus that require air direction control, such as an air conditioner and an air purifier.

The invention claimed is:

1. An apparatus for discharging air, the apparatus comprising:

a duct having a path thereinside through which air flows in forward and backward directions, and having an inlet formed at a rear end thereof and an outlet formed at a front end thereof;

an outlet-side control portion positioned in a front area of a wind direction control member and fixed inside the duct;

an inlet-side control portion having a front end coupled to a support shaft provided at a rear end of the outlet-side control portion, and having a connection shaft formed on a side surface of a rear end thereof; and a drive member configured to rotate the inlet-side control portion upwardly and downwardly about the support shaft, wherein the drive member comprises a drive cam rotatable about a cam drive shaft extending in a vertical direction, the drive cam having a cam groove formed in an oblique direction along an outer circumferential surface thereof, and wherein an outer end of the connection shaft is inserted into the cam groove and moves along the cam groove while the drive cam rotates about the cam drive shaft.

2. The apparatus of claim 1, wherein the duct comprises:

passage portions having a first preset length in the forward and backward directions and provided to face each other at a first preset distance apart in the vertical direction, thereby forming a path through which the air flows; and skin portions positioned in a front end area of the duct in the forward and backward directions, having a second preset length in the forward and backward directions, having areas facing each other at a second preset distance apart in the vertical direction, thereby forming the outlet between the front end, in which the areas facing each other are provided with skin surfaces protruding in a facing direction.

3. The apparatus of claim 2, wherein the skin surfaces are gradually inclined in the facing direction as extending forward.

4. The apparatus of claim 3, wherein the skin surfaces are inclined by a skin inclination angle in the forward and backward directions.

5. The apparatus of claim 2, wherein the outlet-side control portion has at least a partial area positioned between the skin portions.

6. The apparatus of claim 1, wherein the outlet-side control portion is positioned in a central area in the vertical direction in an internal space of the duct.

7. The apparatus of claim 1, wherein the drive cam is provided as a sphere.

* * * * *